US009908007B2

(12) United States Patent
Watanabe et al.

(10) Patent No.: US 9,908,007 B2
(45) Date of Patent: Mar. 6, 2018

(54) MULTI-PIECE SOLID GOLF BALL

(71) Applicant: Bridgestone Sports Co., Ltd., Tokyo (JP)

(72) Inventors: Hideo Watanabe, Chichibushi (JP); Atsuki Kasashima, Chichibushi (JP); Katsunori Sato, Chichibushi (JP)

(73) Assignee: Bridgestone Sports Co., Ltd., Minato-ku, Tokyo (JP)

( * ) Notice: Subject to any disclaimer, the term of this patent is extended or adjusted under 35 U.S.C. 154(b) by 0 days.

(21) Appl. No.: 15/250,256

(22) Filed: Aug. 29, 2016

(65) Prior Publication Data

US 2017/0056732 A1 Mar. 2, 2017

(30) Foreign Application Priority Data

Sep. 2, 2015 (JP) ..... 2015-172780

(51) Int. Cl.
*A63B 37/02* (2006.01)
*A63B 37/00* (2006.01)

(52) U.S. Cl.
CPC ..... *A63B 37/0076* (2013.01); *A63B 37/0017* (2013.01); *A63B 37/0018* (2013.01); *A63B 37/0021* (2013.01); *A63B 37/0031* (2013.01); *A63B 37/0043* (2013.01); *A63B 37/0045* (2013.01); *A63B 37/0046* (2013.01); *A63B 37/0047* (2013.01); *A63B 37/0063* (2013.01); *A63B 37/0064* (2013.01); *A63B 37/0065* (2013.01); *A63B 37/0084* (2013.01); *A63B 37/0087* (2013.01); *A63B 37/0092* (2013.01); *A63B 37/0096* (2013.01)

(58) Field of Classification Search
CPC ..... A63B 37/0076; A63B 37/0065; A63B 37/0046; A63B 37/0038; A63B 37/0039
See application file for complete search history.

(56) References Cited

U.S. PATENT DOCUMENTS

| | | | |
|---|---|---|---|
| 6,913,547 | B2 | 7/2005 | Cavallaro et al. |
| 7,115,049 | B2 | 10/2006 | Sullivan et al. |
| 7,175,542 | B2 | 2/2007 | Watanabe et al. |
| 7,267,621 | B2 | 9/2007 | Sullivan et al. |
| 7,367,901 | B2 | 5/2008 | Watanabe et al. |
| 7,503,855 | B2 | 3/2009 | Sullivan et al. |
| 7,625,302 | B2 | 12/2009 | Watanabe et al. |
| 8,702,535 | B2 | 4/2014 | Sullivan et al. |

(Continued)

OTHER PUBLICATIONS

Compressions by any other name—J. Dalton.*

*Primary Examiner* — John E Simms, Jr.
(74) *Attorney, Agent, or Firm* — Sughrue Mion, PLLC

(57) ABSTRACT

In a multi-piece solid golf ball having a rubber two-layer core consisting of an inner layer and an outer layer, a cover, and at least one intermediate layer therebetween, the inner core layer has a diameter of at least 30 mm, the difference in JIS-C hardness between the center of the inner core layer and the surface of the outer core layer is at least 25, the ball satisfies the relationship A/B≤1.5, where A and B are the deflections of, respectively, the inner core layer and the two-layer core when compressed under specific loading conditions, and the intermediate layer has a higher material hardness than the cover. This ball enables mid- to high-level golfers both to achieve even longer distances and to maintain the spin performance on approach shots at a high level.

8 Claims, 3 Drawing Sheets

(56) References Cited

U.S. PATENT DOCUMENTS

| | | | | |
|---|---|---|---|---|
| 2006/0178231 | A1* | 8/2006 | Kasashima | A63B 37/0004 473/371 |
| 2006/0229143 | A1* | 10/2006 | Watanabe | A63B 37/0004 473/378 |
| 2007/0265113 | A1* | 11/2007 | Hirau | A63B 37/0031 473/376 |
| 2009/0111609 | A1* | 4/2009 | Watanabe | A63B 37/0004 473/373 |
| 2011/0143861 | A1* | 6/2011 | Watanabe | A63B 37/0031 473/373 |
| 2013/0274032 | A1* | 10/2013 | Kasashima | A63B 37/0003 473/371 |
| 2015/0306466 | A1* | 10/2015 | Sullivan | A63B 37/0092 473/376 |

* cited by examiner 6864N (700kgf)

1961N (200kgf)

MULTI-PIECE SOLID GOLF BALL

CROSS-REFERENCE TO RELATED APPLICATION

This non-provisional application claims priority under 35 U.S.C. § 119(a) on Patent Application No. 2015-172780 filed in Japan on Sep. 2, 2015, the entire contents of which are hereby incorporated by reference.

TECHNICAL FIELD

The present invention relates to a multi-piece solid golf ball which has a rubber two-layer core consisting of an inner layer and an outer layer, a cover, and at least one intermediate layer between the core and the cover.

BACKGROUND ART

Recently, various golf balls have been proposed that attempt to achieve the intended spin properties and increase the distance of the ball, both by providing the golf ball with a multilayer structure, and also by imparting the core that makes up most of the ball with a specific hardness profile in such a way as to optimize the core hardness profile and the overall hardness and thickness parameters of the ball. Art has also been proposed which, as a means for optimizing the core hardness profile, from the standpoint of the materials and manufacturing method used, provides the core with a two-layer structure and satisfies a desired core hardness profile. Golf balls in which the core is made of two layers are described in, for example, U.S. Pat. Nos. 6,913,547, 7,115,049, 7,267,621, 7,503,855, 7,175,542, 7,367,901, 7,625,302 and 8,702,535.

However, among mid- to high-level amateur golfers and professionals having intermediate to high head speeds, there is a desire for the commercialization of golf balls having a two-layer core that achieve a longer distance and that also, to further increase the enjoyability of the game, maintain the spin performance on approach shots at a high level.

SUMMARY OF THE INVENTION

It is therefore an object of this invention to provide a multi-piece solid golf ball which, when used by mid- to high-level amateur golfers and professionals having intermediate to high head speeds, makes it possible to achieve a lower spin rate and a high initial velocity on full shots, enabling a good distance to be obtained when hit with a driver (W#1), and moreover which, to increase the enjoyability of the game, also enables the spin performance on approach shots to be maintained at a high level.

As a result of extensive investigations, we have discovered that, in the ball construction of a multi-piece solid golf ball having a core, a cover, and at least one intermediate layer therebetween, by using a core which is made of rubber and has a two-layer construction that is soft on the inside and hard on the outside, this being accomplished by giving the inner core layer a relatively large size with a diameter of at least 30 mm, the spin rate on full shots can be made lower than in golf balls in which the inner core layer has a small diameter. That is, by having the diameter of the inner core layer be at least 30 mm, by having the value obtained by subtracting the center hardness of the inner core layer from the surface hardness of the outer core layer, expressed in terms of JIS-C hardness, be at least 25, and by satisfying the numerical relationship A/B≤1.5, where A is the deflection (mm) of the inner core layer when compressed under a final load of 1,275 N (130 kgf) from an initial load of 98 N (10 kgf) and B is the deflection (mm) of the two-layer core when compressed under a final load of 1,275 N (130 kgf) from an initial load of 98 N (10 kgf), and moreover by forming an intermediate layer and a cover such that the material hardness of the intermediate layer is harder than the material hardness of the cover, it is possible, particularly when the ball is used by mid- to high-level amateur golfers and professionals, both to suppress the spin rate on full shots and thus further increase the distance and also to elevate the spin performance on approach shots, enhancing the enjoyability of playing the ball in the short game.

As used herein, "mid- to high-level amateur golfer" refers to amateur golfers having head speeds (HS) of generally 40 to 50 m/s, with mid-level amateur golfers having head speeds of about 40 to 48 m/s and high-level amateur golfers having head speeds of about 42 to 50 m/s.

Accordingly, the invention provides a multi-piece solid golf ball having a rubber two-layer core consisting of an inner layer and an outer layer, a cover, and at least one intermediate layer between the core and the cover, wherein the inner core layer has a diameter of at least 30 mm, the value obtained by subtracting a center hardness of the inner core layer from a surface hardness of the outer core layer, expressed in terms of JIS-C hardness, is at least 25, the ball satisfies the relationship A/B≤1.5, where A is the deflection (mm) of the inner core layer when compressed under a final load of 1,275 N (130 kgf) from an initial load of 98 N (10 kgf) and B is the deflection (mm) of the two-layer core when compressed under a final load of 1,275 N (130 kgf) from an initial load of 98 N (10 kgf), and the intermediate layer has a higher material hardness than the cover.

In a preferred embodiment of the inventive golf ball, the core has a hardness profile which satisfies the conditions:

$$1 \leq C10 - Cc \leq 15, \quad \text{(i)}$$

$$C10 - Cc < Cs - C10, \quad \text{(ii)}$$

$$18 \leq Cs - C10, \quad \text{(iii)}$$

$$Cs \geq 80, \text{ and} \quad \text{(iv)}$$

$$Cc \geq 50. \quad \text{(v)}$$

Here, Cc is the JIS-C hardness at a center of the core, C5 is the JIS-C hardness at a position 5 mm from the core center, C10 is the JIS-C hardness at a position 10 mm from the core center, C15 is the JIS-C hardness at a position 15 mm from the core center, and Cs is the JIS-C hardness at a surface of the core.

In another preferred embodiment, the golf ball satisfies the condition:

$$1.5 \leq (Cs - C10)/(C10 - Cc) \leq 4. \quad \text{(vi)}$$

In yet another preferred embodiment, the golf ball satisfies the condition:

$$25 \leq Cs - Cc \leq 45. \quad \text{(viii)}$$

In still another preferred embodiment, the golf ball satisfies the condition:

$$C10 - C5 \leq C5 - Cc \leq Cs - C15 \leq C15 - C10. \quad \text{(viii)}$$

In a further preferred embodiment, the golf ball satisfies the relationship A/C≤1.9, where C is the deflection (mm) of a sphere consisting of the core encased by the intermediate layer when the sphere is compressed under a final load of 1,275 N (130 kgf) from an initial load of 98 N (10 kgf).

In yet a further preferred embodiment, the golf ball satisfies the relationships A/H≤2.0 and A−H≤2.5, where H is the deflection (mm) of the ball when compressed under a final load of 1,275 N (130 kgf) from an initial load of 98 N (10 kgf).

In a still further preferred embodiment, the golf ball satisfies the condition:

$$PS_7/S/H\times100\geq5.90\ (mm^{-1}),\qquad\text{(ix)}$$

where $PS_7$ is the pressed area ($mm^2$), defined as the area of the golf ball that comes into contact with a flat surface, when the ball is subjected to a load of 6,864 N (700 kgf), S is the hypothetical planar area ($mm^2$), defined as the surface area of a cross-sectional circle along the ball diameter were the surface of the ball to be entirely free of dimples, and H is the deflection (mm) of the ball when compressed under a final load of 1,275 N (130 kgf) from an initial load of 98 N (10 kgf).

In yet another preferred embodiment, the golf ball satisfies the condition:

$$PS_2/S/H\times100\geq1.70\ (mm^{-1}),\qquad\text{(x)}$$

where $PS_7$ is the pressed area ($mm^2$), defined as the area of the golf ball that comes into contact with a flat surface, when the ball is subjected to a load of 1,961 N (200 kgf), S is the hypothetical planar area ($mm^2$), defined as the surface area of a cross-sectional circle along the ball diameter were the surface of the ball to be entirely free of dimples, and H is the deflection (mm) of the ball when compressed under a final load of 1,275 N (130 kgf) from an initial load of 98 N (10 kgf).

Advantageous Effects of the Invention

The multi-piece solid golf ball of the invention, when used by mid- to high-level golfers, enables the spin rate on full shots with a driver (W#1) to be sufficiently lowered, making it possible to achieve an increased distance, and also enables the spin performance on approach shots to be maintained at a high level.

BRIEF DESCRIPTION OF THE DIAGRAMS

DESCRIPTION OF THE PREFERRED EMBODIMENTS

Figure 1A:
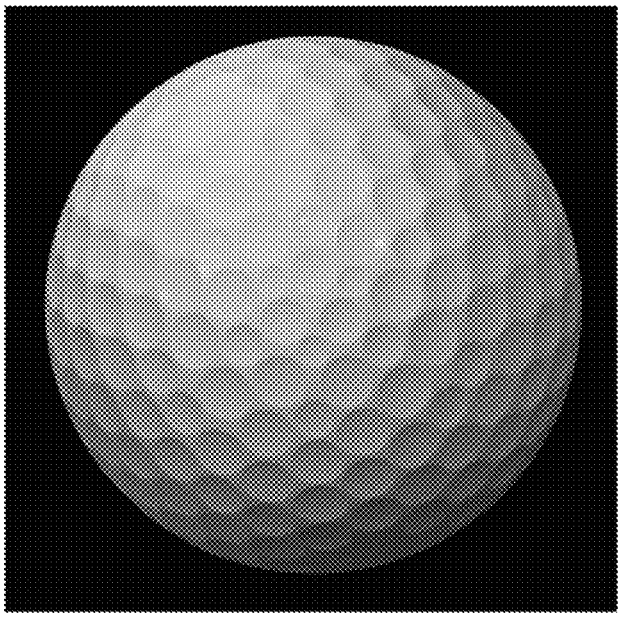
FIGS. 1A and 1B are enlarged cross-sectional diagrams of a dimple on the golf balls used in Working Examples 1 and 2.

The objects, features and advantages of the invention will become more apparent from the following detailed description, taken in conjunction with the foregoing diagram.

The multi-piece solid golf ball of the invention has a ball construction with a rubber two-layer core consisting of an inner layer and an outer layer, a cover, and at least one intermediate layer between the core and the cover.

The core, although not shown in the diagrams, is formed as two layers: an inner layer and an outer layer. The inner core layer has a diameter of at least 30 mm, preferably from 30 to 40 mm, more preferably from 33 to 38 mm, and even more preferably from 35 to 35.5 mm. When the diameter of the inner core layer is too small, the initial velocity of the ball on shots with a driver (W#1) is low, as a result of which the intended distance may not be obtained. On the other hand, when the inner core layer diameter is too large, the durability to cracking on repeated impact may worsen or the spin rate-lowering effect on full shots may be inadequate, as a result of which the intended distance may not be obtained.

The outer core layer has a thickness which, although not particularly limited, is preferably from 1.0 to 3.0 mm, more preferably from 1.2 to 2.5 mm, and even more preferably from 1.5 to 2.0 mm. When the outer core layer is too thick, the initial velocity on full shots may be low, as a result of which the intended distance may not be achieved. On the other hand, when the outer core layer is too thin, the durability to cracking on repeated impact may worsen and the spin rate-lowering effect on full shots may be inadequate, as a result of which the intended distance may not be obtained.

The center hardness (CC) of the inner core layer described below (also referred to as "the core center hardness") and the cross-sectional hardnesses at specific positions refer to hardnesses measured at the center and specific positions in a cross-section obtained by cutting the core in half through the center. The surface hardness (Cs) refers to the hardness measured at the surface (spherical surface) of the core. The surface hardness (Cs) also refers to the surface hardness of the outer core layer.

The center hardness (Cc) of the inner core layer, expressed in terms of JIS-C hardness, is preferably at least 50, more preferably from 51 to 57, and even more preferably from 52 to 55. When the center hardness of the inner core layer is too large, the spin rate may rise excessively, as a result of which a good distance may not be achieved, and the ball may have a hard feel at impact. On the other hand, when the center hardness is too small, the durability to cracking on repeated impact may worsen and the feel of the ball at impact may be too soft.

The JIS-C hardness at a position 5 mm from the center of the inner core layer (C5) is preferably from 56 to 66, more preferably from 58 to 64, and even more preferably from 60 to 62. The JIS-C hardness at a position 10 mm from the center of the inner core layer (C10) is preferably from 59 to 69, more preferably from 61 to 67, and even more preferably from 63 to 65. When these hardness values are too large, the spin rate may rise excessively, as a result of which a good distance may not be obtained, or the feel at impact may be hard. On the other hand, when these values are too small, the durability to cracking on repeated impact may worsen and the feel at impact may become too soft.

The JIS-C hardness at a position 15 mm from the center of the inner core layer (C15) is preferably from 73 to 83, more preferably from 75 to 81, and even more preferably from 77 to 79. When this hardness value is too high, the feel at impact may be hard and the durability to cracking on repeated impact may worsen. On the other hand, when this hardness value is too low, the spin rate may rise excessively and the rebound may decrease, as a result of which a good distance may not be obtained.

The C10−Cc value is preferably from 1 to 15, more preferably from 5 to 13, and even more preferably from 10 to 12. This value means that, from the core center out to about 10 mm, the hardness profile does not have a very steep gradient. The C5−Cc value is preferably from 5 to 11, more preferably from 6 to 10, and even more preferably from 7 to 9. When this value is too large, the initial velocity on full shots may be low and the intended distance may not be obtained. On the other hand, when this value is too small, the spin rate on full shots may become high and the intended distance may not be obtained.

The C10–C5 value is preferably from 1 to 7, more preferably from 2 to 5, and even more preferably from 3 to 4. When the C10–C5 value falls outside of this range, the spin rate on full shots may rise excessively and a good distance may not be obtained, or the durability to cracking on repeated impact may worsen.

The surface hardness of the outer core layer (Cs), expressed in terms of JIS-C hardness, is preferably at least 80, more preferably from 81 to 95, and even more preferably from 82 to 93. When the surface hardness of this outer core layer is too large, the feel at impact may harden, or the durability to cracking on repeated impact may worsen. On the other hand, when this value is too small, the spin rate may rise excessively, or the rebound may be low and a good distance may not be obtained.

The hardness difference between the surface hardness of the outer core layer and the center hardness of the inner core layer (Cs–Cc), expressed in terms of JIS-C hardness, is preferably at least 25, more preferably from 28 to 45, and even more preferably from 30 to 40. When this hardness difference is too large, the durability to cracking on repeated impact may worsen. On the other hand, when this hardness difference is too small, the spin rate may rise excessively and a good distance may not be achieved.

The Cs–C10 value is preferably at least 18, more preferably from 19 to 35, and even more preferably from 21 to 30. This means that, from a position 10 mm from the core center to the core surface, the hardness profile has a steep gradient that, in terms of JIS-C hardness, exceeds 18. When this value is too large, the durability to cracking on repeated impact may worsen or the feel at impact may worsen. On the other hand, when this value is too small, the spin rate-lowering effect on full shots may be inadequate, as a result of which the intended distance may not be achieved.

The Cs–C10 value is preferably larger than the C10–Cc value. This means that, in the core hardness profile, the outside of the core has a steeper hardness gradient that the core interior. The value (Cs–C10)/(C10–Cc) is preferably from 1.5 to 40, more preferably from 1.7 to 3.3, and even more preferably from 2.0 to 2.6. When this value is too large, the durability to cracking on repeated impact may worsen. On the other hand, when this value is too small, the spin rate-lowering effect on full shots may be inadequate, as a result of which the intended distance may not be obtained.

In the above core hardness profile, it is preferable for the following condition to be satisfied:

$$C10-C5 \leq C5-Cc \leq Cs-C15 \leq C15-C10$$

When this relationship is not satisfied, the spin rate-lowering effects on full shots may be inadequate, or the initial velocity on actual shots may be low, as a result of which the intended distance may not be obtained.

The inner core layer has a deflection (mm) when compressed under a final load of 1,275 N (130 kgf) from an initial load of 98 N (10 kgf) which, although not particularly limited, is preferably from 3.6 to 5.1 mm, more preferably from 3.9 to 4.8 mm, and even more preferably from 4.2 to 4.5 mm. Also, the sphere obtained by encasing the inner core layer with the outer core layer, i.e., the overall core, has a deflection (mm) under a final load of 1,275 N (130 kgf) from an initial load of 98 N (10 kgf) which, although not particularly limited, is preferably from 3.1 to 4.2 mm, more preferably from 3.3 to 4.0 mm, and even more preferably from 3.5 to 3.8 mm. When this value is too large, the feel at impact may be too soft, the durability to repeated impact may worsen, or the initial velocity on full shots may be low, as a result of which the intended distance may not be obtained. When this value is too small, the feel at impact may be too hard or the spin rate on full shots may increase, as a result of which the intended distance may not be obtained.

In this invention, letting A be the deflection (mm) of the inner core layer when compressed under a final load of 1,275 N (130 kgf) from an initial load of 98 N (10 kgf) and B be the deflection (mm) of the two-layer core when compressed under a final load of 1,275 N (130 kgf) from an initial load of 98 N (10 kgf), it is essential that the value A/B be 1.5 or less, preferably from 0.8 to 1.4, and more preferably from 1.0 to 1.3. When this value is too small, the feel at impact may be too soft and the initial velocity on full shots may be low, as a result of which the intended distance on shots with a driver (W#1) may not be obtained. On the other hand, when the A/B value is too large, the feel at impact may be too hard and the spin rate on full shots may rise excessively, as a result of which the intended distance on shots with a driver (W#1) may not be obtained.

The inner core layer and outer core layer which have the above hardness profiles and deflections are preferably made of materials that are composed primarily of rubber. The rubber material making up the outer core layer encasing the inner core layer may be the same as or different from the rubber material making up the inner core layer. For example, use may be made of a rubber composition obtained by compounding a base rubber as the chief component and, together with this, other ingredients such as a co-crosslinking agent, an organic peroxide, an inert filler and an organosulfur compound.

Polybutadiene is preferably used as the base rubber. The polybutadiene has a cis-1,4 bond content on the polymer chain of typically at least 60 wt %, preferably at least 80 wt %, more preferably at least 90 wt %, and most preferably at least 95 wt %. When the content of cis-1,4 bonds among the bonds on the polybutadiene molecule is too low, the resilience may decrease.

Rubber components other than this polybutadiene may be included in the base rubber within a range that does not detract from the advantageous effects of the invention. Examples of such rubber components other than the foregoing polybutadiene include other polybutadienes, and diene rubbers other than polybutadiene, such as styrene-butadiene rubber, natural rubber, isoprene rubber and ethylene-propylene-diene rubber.

The organic peroxide used in the invention is not particularly limited, although the use of an organic peroxide having a one-minute half-life temperature of 110 to 185° C. is preferred. One, two or more organic peroxides may be used. The amount of organic peroxide included per 100 parts by weight of the base rubber is preferably at least 0.1 part by weight, and more preferably at least 0.3 part by weight. The upper limit is preferably not more than 5 parts by weight, more preferably not more than 4 parts by weight, and even more preferably not more than 3 parts by weight. A commercially available product may be used as the organic peroxide. Specific examples include those available under the trade names Percumyl D, Perhexa C-40, Niper BW and Peroyl L (all from NOF Corporation), and Luperco 231XL (from Atochem Co.).

The co-crosslinking agent is exemplified by unsaturated carboxylic acids and the metal salts of unsaturated carboxylic acids. Illustrative examples of unsaturated carboxylic acids include acrylic acid, methacrylic acid, maleic acid and fumaric acid. Acrylic acid and methacrylic acid are especially preferred. Metal salts of unsaturated carboxylic acids are not particularly limited, and are exemplified by those obtained by neutralizing the foregoing unsaturated carboxylic acids with the desired metal ions. Illustrative examples include the zinc salts and magnesium salts of methacrylic acid and acrylic acid. The use of zinc acrylate is especially preferred.

These unsaturated carboxylic acids and/or metal salts thereof are included in an amount per 100 parts by weight of the base rubber which is typically at least 10 parts by weight, preferably at least 15 parts by weight, and more preferably at least 20 parts by weight. The upper limit is typically not more than 60 parts by weight, preferably not more than 50 parts by weight, more preferably not more than 45 parts by weight, and most preferably not more than 40 parts by weight. When too much is included, the feel of the ball may become too hard and unpleasant. When too little is included, the rebound may decrease.

In order to have the core satisfy the desired hardness profile described above, water or a water-containing material may be added when compounding the various ingredients of the core-forming rubber composition. Decomposition of the organic peroxide within the core formulation can be promoted by the direct addition of water (or a water-containing material) to the core material. It is known that the decomposition efficiency of the organic peroxide within the core-forming rubber composition changes with temperature and that, starting at a given temperature, the decomposition efficiency rises with increasing temperature. If the temperature is too high, the amount of decomposed radicals rises excessively, leading to recombination between radicals and, ultimately, deactivation. As a result, fewer radicals act effectively in crosslinking. Here, when a heat of decomposition is generated by decomposition of the organic peroxide at the time of core vulcanization, the vicinity of the core surface remains at substantially the same temperature as the temperature of the vulcanization mold, but the temperature near the core center, due to the build-up of heat of decomposition by the organic peroxide which has decomposed from the outside, becomes considerably higher than the mold temperature. In cases where water (or a water-containing material) is added directly to the core, because the water acts to promote decomposition of the organic peroxide, radical reactions like those described above can be made to differ at the core center and at the core surface. That is, decomposition of the organic peroxide is further promoted near the center of the core, bringing about greater radical deactivation, which leads to a further decrease in the amount of active radicals. As a result, it is possible to obtain a core in which the crosslink densities at the core center and the core surface differ markedly. It is also possible to obtain a core having different dynamic viscoelastic properties at the core center. Along with achieving a lower spin rate, golf balls having such a core are also able to exhibit excellent durability and undergo less change over time in rebound. When zinc monoacrylate is used instead of the above water, water is generated from the zinc monoacrylate by heat during kneading of the compounding materials. An effect similar to that obtained by the addition of water can thereby be obtained.

The water used here is not particularly limited, and may be distilled water or tap water. The use of distilled water which is free of impurities is especially preferred. The amount of water included per 100 parts by weight of the base rubber is preferably at least 0.1 part by weight, and more preferably at least 0.3 part by weight. The upper limit is preferably not more than 5 parts by weight, and more preferably not more than 4 parts by weight.

The production of such a core composed of two layers may entail molding an inner core layer by, for example, the customary method of forming a sphere under heating and compression at a temperature of at least 140° C. but not more than 180° C. for a period of at least 10 minutes but not more than 60 minutes. The method employed to form the outer core layer on the surface of the inner core layer may involve forming a pair of half-cups from unvulcanized rubber sheet, placing and enclosing the inner core layer within the pair of half-cups, then molding under heat and pressure. For example, advantageous use may be made of a process in which initial vulcanization (semi-vulcanization) is carried out to produce a pair of hemispherical cups, following which a prefabricated inner core layer is placed in one of the hemispherical cups and covered by the other hemispherical cup, and secondary vulcanization (complete vulcanization) is subsequently carried out. Another preferred production process involves forming the rubber composition while in an unvulcanized state into sheets so as to make a pair of outer core layer sheets, and shaping the sheets with a die having a hemispherical protrusion so as to produce unvulcanized hemispherical cups. The pair of hemispherical cups is then placed over a prefabricated inner core layer and formed into a spherical shape under heating and compression at a temperature of 140 to 180° C. for a period of 10 to 60 minutes, thereby dividing the vulcanization step into two stages.

Next, the intermediate layer is described.

The intermediate layer has a material hardness expressed in terms of Shore D hardness which, although not particularly limited, is preferably from 57 to 67, more preferably from 59 to 65, and even more preferably from 61 to 63. The sphere consisting of the core encased by the intermediate layer, referred to below as the "intermediate layer-encased sphere," has a surface hardness, expressed in terms of Shore D hardness, which is preferably from 64 to 74, more preferably from 66 to 72, and even more preferably from 68 to 70. When the intermediate layer is too soft, the spin rate on full shots may rise excessively, as a result of which a good distance may not be achieved. On the other hand, when the intermediate layer is too hard, the durability to cracking on repeated impact may worsen and the feel of the ball on shots with a putter or on short approaches may become too hard.

The intermediate layer-encased sphere has a deflection (mm) when compressed under a final load of 1,275 N (130 kgf) from an initial load of 98 N (10 kgf) which, although not particularly limited, is preferably from 2.4 to 3.6 mm, more preferably from 2.6 to 3.4 mm, and even more preferably from 2.8 to 3.1 mm. When this value is too large, the feel of the ball may be too soft, the durability to repeated impact may be poor, and the initial velocity on full shots may be low, as a result of which the intended distance may not be achieved. On the other hand, when this value is too small, the feel of the ball may be too hard and the spin rate on full shots may rise, as a result of which the intended distance may not be achieved.

The value obtained by subtracting the surface hardness of the outer core layer from the surface hardness of the intermediate layer-encased sphere, expressed in terms of JIS-C hardness, is preferably from 1 to 20, more preferably from 3 to 16, and even more preferably from 5 to 13. When this value falls outside of the foregoing range, the spin rate-lowering effect on full shots may be inadequate, as a result of which the intended distance may not be obtained, or the durability to cracking on repeated impact may worsen.

Letting C be the deflection (mm) of the intermediate layer-encased sphere when compressed under a final load of 1,275 N (130 kgf) from an initial load of 98 N (10 kgf), the value A/C is preferably not more than 1.9, more preferably from 1.2 to 1.7, and even more preferably from 1.4 to 1.5. When this value is too small, the feel at impact may be too soft and the initial velocity on full shots may be too low, as a result of which the intended distance on shots with a driver (W#1) may not be obtained. On the other hand, when the value A/C is too large, the feel at impact may be too hard and the spin rate on full shots may rise excessively, as a result of which the intended distance on shots with a driver (W#1) may not be obtained.

The intermediate layer has a thickness of preferably from 0.8 to 2.1 mm, more preferably from 1.0 to 1.7 mm, and even more preferably from 1.2 to 1.4 mm. The thickness of the intermediate layer is preferably higher than the thickness of the subsequently described cover (outermost layer). When the intermediate layer thickness falls outside of this range or is thinner than the cover, the spin rate-lowering effect on shots with a driver (W#1) may be inadequate, as a result of which a good distance may not be achieved.

The intermediate layer material is not particularly limited, although preferred use can be made of various thermoplastic resin materials. To fully achieve the desired effects of the invention, it is especially preferable to use a high-resilience resin material as the intermediate layer material. For example, the use of an ionomer resin material or the subsequently described highly neutralized resin material is preferred.

Specifically, a molded material obtained by molding a resin composition of components (I) to (IV) described below under applied heat may be used as the highly neutralized resin material.

Preferred use can be made of the two following components (I) and (II) as the base resins:

(I) An olefin-unsaturated carboxylic acid-unsaturated carboxylic acid ester terpolymer, or a metal neutralization product thereof, having a weight-average molecular weight (Mw) of at least 140,000, an acid content of 10 to 15 wt % and an ester content of at least 15 wt %; and (II) An olefin-acrylic acid random copolymer, or a metal neutralization product thereof, having a weight-average molecular weight (Mw) of at least 140,000 and an acid content of 10 to 15 wt %.

The weight-average molecular weight (Mw) of component (I) is at least 140,000, and preferably at least 145,000. The weight-average molecular weight (Mw) of component (II) is at least 140,000, and preferably at least 160,000. By thus making these molecular weights large, the resin material can be assured of having sufficient resilience.

It is thought that because the acid components and ester contents of the respective copolymers serving as the base resins (I) and (II) differ, these two types of base resins interlock in a complex manner, giving rise to molecular synergistic effects that can increase the rebound and durability of the ball. In this invention, by specifying the weight-average molecular weight, acid content and ester content as indicated above in such a way as to select a material that is relatively soft as the terpolymer serving as base resin (I), and by specifying the type of acid, weight-average molecular weight and acid content in such a way as to select a relatively hard material as base resin (II), it is possible with a blend of these polymers to ensure sufficient resilience and durability for use as a golf ball material.

Here, the weight-average molecular weight (Mw) is a value calculated relative to polystyrene in gel permeation chromatography (GPC). A word of explanation is needed here concerning GPC molecular weight measurement. It is not possible to directly take GPC measurements for copolymers and terpolymers because these molecules are adsorbed to the GPC column owing to unsaturated carboxylic acid groups within the molecules. Instead, the unsaturated carboxylic acid groups are generally converted to esters, following which GPC measurement is carried out and the polystyrene-equivalent average molecular weights Mw and Mn are calculated.

The olefins used in component (I) and component (II) preferably have 2 to 6 carbons, with ethylene being especially preferred. The unsaturated carboxylic acid used in component (I) is not particularly limited, although preferred use can be made of acrylic acid or methacrylic acid. To ensure resilience, the unsaturated carboxylic acid used in component (II) is acrylic acid. This is because, when methacrylic acid is used as the unsaturated carboxylic acid in component (II), the methacrylic acid with its pendant methyl group may give rise to a buffering action, lowering the reactivity.

The unsaturated carboxylic acid content (acid content) within each of components (I) and (II), although not particularly limited, is preferably at least 10 wt %, with the upper limit being preferably less than 15 wt %, and more preferably less than 13 wt %. When this acid content is low, moldings of the golf ball material may lack sufficient resilience. On the other hand, when the acid content is high, the hardness may become excessively high, adversely affecting the durability.

The unsaturated carboxylic acid ester used in the terpolymer serving as component (I) is preferably a lower alkyl ester, with butyl acrylate (butyl n-acrylate, butyl i-acrylate) being especially preferred.

The ester content of the unsaturated carboxylic acid ester in component (I), in order to employ a resin that is relatively soft compared with the binary copolymer serving as component (II), is set to at least 15 wt %, preferably at least 18 wt %, and more preferably at least 20 wt %, with the upper limit being preferably not more than 25 wt %. At an ester content higher than this range, moldings of the intermediate layer material may lack sufficient resilience. On the other hand, when the ester content is low, the hardness may increase, adversely affecting the durability.

The hardness of the base resin (I), that is, the hardness when the resin itself is molded alone (material hardness), expressed in terms of Shore D hardness, is preferably at least 30, and more preferably at least 35, with the upper limit being preferably not more than 50, and more preferably not more than 45. The hardness of the base resin (II), that is, the hardness when the resin itself is molded alone (material hardness), expressed in terms of Shore D hardness, is preferably at least 40, and more preferably at least 50, with the upper limit being preferably not more than 60, and more preferably not more than 57. When base resins outside of these respective hardness ranges are used, a material having the desired hardness may not be obtained, or an adequate resilience and durability may not be obtained.

It is preferable for component (I) and component (II) to be used together. The mixing proportions of component (I) and component (II), expressed as the weight ratio (I):(II), is set to preferably 90:10 to 10:90, more preferably 85:15 to 30:70, and even more preferably 80:20 to 50:50. When the proportion of component II is higher than this range, the hardness increases, as a result of which the material may be difficult to mold.

When metal neutralization products of resins (i.e., ionomers) are used as components (I) and (II), the type of metal neutralization product and the degree of neutralization are not particularly limited. Illustrative examples include 60 mol % Zn (degree of neutralization with zinc) ethylene-methacrylic acid copolymers, 40 mol % Mg (degree of neutralization with magnesium) ethylene-methacrylic acid copolymers, and 40 mol % Mg (degree of neutralization with magnesium) ethylene-methacrylic acid-acrylic acid ester terpolymers.

To ensure at least a given degree of flowability during injection molding and provide a good molding processability, it is essential for the melt flow rates of the resins serving as components (I) and (II) to each be from 0.5 to 20 g/10 min. The difference between the melt flow rates of components (I) and (II) is set to not more than 15 g/10 min. When the difference in melt flow rates between these base resins is too large, the components cannot be uniformly mixed together during the compounding of components (I) and (II) in an extruder, and so the mixture becomes non-uniform, which may lead to injection molding defects.

As noted above, copolymers or ionomers with weight-average molecular weights (Mw) set in specific ranges are used as components (I) and (II). Illustrative examples of commercial products that may be used for this purpose include the Nucrel series (DuPont-Mitsui Polychemicals Co., Ltd.), the Escor series (ExxonMobil Chemical), the Surlyn series (E.I. DuPont de Nemours & Co.), and the Himilan series (DuPont-Mitsui Polychemicals Co., Ltd.).

In addition, (III) a basic inorganic metal compound is preferably included as a component for neutralizing acid groups in above components (I) and (II) and subsequently described component (IV). By even more highly neutralizing the resin material in this way, the spin rate of the ball on full shots is even further reduced without adversely affecting the feel of the ball, thus making an increased distance fully achievable. Illustrative examples of the metal ions in the basic inorganic metal compound include $Na^+$, $K^+$, $Li^+$, $Zn^{2+}$, $Ca^{2+}$, $Mg^{2+}$, $Cu^{2+}$ and $Co^{2+}$. Of these, $Na^+$, $Zn^{2+}$, $Ca^{2+}$ and $Mg^{2+}$ are preferred, and $Mg^{2+}$ is more preferred. These metal salts may be introduced into the resin using, for example, formates, acetates, nitrates, carbonates, bicarbonates, oxides and hydroxides.

This basic inorganic metal compound (III) is included in the resin composition in an amount equivalent to at least 70 mol %, based on the acid groups in the resin composition. Here, the amount in which the basic inorganic metal compound serving as component (III) is included may be selected as appropriate for obtaining the desired degree of neutralization. Although this amount depends also on the degree of neutralization of the base resins (components (I) and (II)) that are used, in general it is preferably from 1.0 to 2.5 parts by weight, more preferably from 1.1 to 2.3 parts by weight, and even more preferably from 1.2 to 2.0 parts by weight, per 100 parts by weight of the combined amount of the base resins (components (I) and (II)). The degree of neutralization of the acid groups in components (I) to (IV) is preferably at least 70 mol %, more preferably at least 90 mol %, and even more preferably at least 100 mol %.

Next, the anionic surfactant serving as component (IV) is described. The reason for including an anionic surfactant is to improve the durability after resin molding while ensuring good flowability of the overall resin composition. The anionic surfactant is not particularly limited, although the use of one having a molecular weight of from 140 to 1,500 is preferred. Exemplary anionic surfactants include carboxylate surfactants, sulfonate surfactants, sulfate ester surfactants and phosphate ester surfactants. Preferred examples include one, two or more selected from the group consisting of various fatty acids such as stearic acid, behenic acid, oleic acid and maleic acid, derivatives of these fatty acids, and metal salts thereof. Selection from the group consisting of stearic acid, oleic acid and mixtures thereof is especially preferred. Alternatively, exemplary organic acid metal salts that may serve as component (IV) include metal soaps, with the metal salt being one in which a metal ion having a valence of 1 to 3 is used. The metal is preferably selected from the group consisting of lithium, sodium, magnesium, aluminum, potassium, calcium and zinc, with the use of metal salts of stearic acid being especially preferred. Specifically, the use of magnesium stearate, calcium stearate, zinc stearate or sodium stearate is preferred.

Component (IV) is included in an amount, per 100 parts by weight of the base resins serving as components (I) and (II), of 1 to 100 parts by weight, preferably 10 to 90 parts by weight, and more preferably 20 to 80 parts by weight. When the component (IV) content is too low, it may be difficult to lower the hardness of the resin material. On the other hand, at a high content, the resin material is difficult to mold and bleeding at the material surface increases, adversely affecting the molded article.

In this invention, the moldability of the material and the productivity can be further increased by suitably adjusting the compounding ratio between components (III) and (IV). When the content of the basic inorganic metal compound serving as component (III) is too high, the amount of gases such as organic acids that evolve during molding decreases, but the flowability of the material diminishes. Conversely, when the content of component (III) is low, the amount of gases generated increases. On the other hand, when the content of the anionic surfactant serving as component (IV) is too high, the amount of gas consisting of fatty acids and other organic acids increases during molding, which has a large impact in terms of molding defects and productivity. Conversely, when the content of component (IV) is low, the amount of gases generated decreases, but the flowability and durability decline. Therefore, achieving a proper compounding balance between components (III) and (IV) is also important. Specifically, it is desirable to set the compounding ratio between components (III) and (IV), expressed as the weight ratio (III):(IV), to from 4.0:96.0 to 1.0:99.0, and especially from 3.0:97.0 to 1.5:98.5.

The resin composition of above components (I) to (IV) accounts for preferably at least 50 wt %, more preferably at least 60 wt %, even more preferably at least 70 wt %, and most preferably at least 90 wt %, of the total amount of the intermediate layer material.

A non-ionomeric thermoplastic elastomer may be included in the intermediate layer material. The non-ionomeric thermoplastic elastomer is preferably included in an amount of from 1 to 50 parts by weight per 100 parts by weight of the combined amount of the base resins.

The non-ionomeric thermoplastic elastomer is exemplified by polyolefin elastomers (including polyolefins and metallocene-catalyzed polyolefins), polystyrene elastomers, diene polymers, polyacrylate polymers, polyamide elastomers, polyurethane elastomers, polyester elastomers and polyacetals.

Optional additives may be suitably included in the intermediate layer material according to the intended use. For example, various additives such as pigments, dispersants, antioxidants, ultraviolet absorbers and light stabilizers may be added. When such additives are included, the content thereof per 100 parts by weight of components (I) to (IV) combined is preferably at least 0.1 part by weight, and more preferably at least 0.5 part by weight, with the upper limit being preferably not more than 10 parts by weight, and more preferably not more than 4 parts by weight.

It is desirable to abrade the surface of the intermediate layer in order to increase adhesion with the polyurethane that is preferably used in the subsequently described cover (outermost layer). In addition, it is desirable to apply a primer (adhesive) to the surface of the intermediate layer following such abrasion treatment or to add an adhesion reinforcing agent to the intermediate layer material.

The intermediate layer material has a specific gravity which is typically less than 1.1, preferably from 0.90 to 1.05, and more preferably from 0.93 to 0.99. Outside of this range, the rebound becomes small, as a result of which a good distance may not be obtained, or the durability to cracking on repeated impact may worsen.

Next, the cover, which is the outermost layer of the ball, is described.

The cover (outermost layer) has a material hardness expressed in terms of Shore D hardness which, although not particularly limited, is preferably from 34 to 58, more preferably from 40 to 56, and even more preferably from 48 to 54.

The cover-encased sphere, i.e., the ball, has a surface hardness expressed in terms of Shore D hardness which is preferably from 40 to 70, more preferably from 46 to 68, and even more preferably from 54 to 66. When the cover-encased sphere is softer than this range, the spin rate on driver (W#1) shots and iron shots may become too high, as a result of which a good distance may not be obtained. When the cover is harder than this range, the spin rate on approach shots may be inadequate or the feel at impact may be too hard.

The value obtained by subtracting the surface hardness of the intermediate layer-encased sphere from the surface hardness of the ball, expressed in terms of Shore D hardness, is preferably from −9 to −1, more preferably from −7 to −2, and even more preferably from −5 to −3. When this value is larger (less negative), the ball may be less receptive to spin on approach shots, or the durability to cracking on repeated impact may worsen. On the other hand, when this value is too small (larger in the negative direction), the spin rate on full shots may increase, or the initial velocity of the ball may decrease, as a result of which the intended distance may not be achieved.

The cover-encased sphere, i.e., the ball, has a deflection (mm) when compressed under a final load of 1,275 N (130 kgf) from an initial load of 98 N (10 kgf) which, although not particularly limited, is preferably from 2.2 to 3.5 mm, more preferably from 2.4 to 3.2 mm, and even more preferably from 2.6 to 2.9 mm. When this value is too large, the feel of the ball may be too soft, the durability to repeated impact may worsen, or the initial velocity on full shots may be low, as a result of which the intended distance may not be obtained. On the other hand, when this value is too small, the feel of the ball may be too hard and the spin rate on full shots may rise, as a result of which the intended distance may not be obtained.

Letting H be the deflection (mm) of the golf ball when compressed under a final load of 1,275 N (130 kgf) from an initial load of 98 N (10 kgf), the value A/H is preferably not more than 2.0, more preferably from 1.2 to 1.8, and even more preferably from 1.5 to 1.6. When this value is too small, the feel at impact may become too soft and the initial velocity on full shots may be too low, as a result of which the intended distance on shots with a driver (W#1) may not be obtained. On the other hand, when the value A/H is too large, the feel at impact may become too hard and the spin rate on full shots may rise excessively, as a result of which the intended distance on shots with a driver may not be obtained.

The value A−H is preferably not more than 2.5 mm, more preferably from 0.8 to 2.2 mm, even more preferably from 1.0 to 2.0 mm, and still more preferably from 1.3 to 1.8 mm. When this value is too small, the spin rate on full shots may rise excessively and the intended distance on shots with a driver may not be obtained. On the other hand, when this value is too large, the initial velocity on full shots may be too low, as a result of which the intended distance on driver shots may not be obtained.

The cover serving as the outermost layer of the ball has a thickness which, although not particularly limited, is preferably from 0.3 to 1.5 mm, more preferably from 0.45 to 1.2 mm, and even more preferably from 0.6 to 0.9 mm. When the cover is thicker than this range, the rebound on W#1 shots and iron shots may be inadequate and the spin rate may rise, as a result of which a good distance may not be obtained. On the other hand, when the cover is thinner than this range, the scuff resistance may worsen and the ball may lack spin receptivity on approach shots, resulting in poor controllability.

It is preferable for the cover thickness to be smaller than the thickness of the intermediate layer; that is, for the intermediate layer to be formed so as to be thicker than the cover. The value obtained by subtracting the cover thickness from the intermediate layer thickness is preferably from 0.1 to 1.0 mm, more preferably from 0.2 to 0.8 mm, and even more preferably from 0.3 to 0.6 mm. When this value is too large, the feel at impact may be too hard or the ball may have a poor receptivity to spin on approach shots. On the other hand, when this value is too small, the durability to cracking on repeated impact may worsen, or the spin rate-lowering effect on full shots may be inadequate, as a result of which the intended distance may not be achieved.

The cover (outermost layer) material is not particularly limited, although any of various types of thermoplastic resin materials or thermoset resin materials may be used. For reasons having to do with controllability and scuff resistance, it is preferable to use a urethane resin as the cover material. In particular, from the standpoint of the mass productivity of manufactured golf balls, it is preferable to use a cover material composed primarily of a thermoplastic polyurethane, with formation more preferably being carried out using a resin blend composed primarily of (A) a thermoplastic polyurethane and (B) a polyisocyanate compound.

In the thermoplastic polyurethane composition containing above components (A) and (B), to improve the ball properties even further, a necessary and sufficient amount of unreacted isocyanate groups should be present in the cover resin material. Specifically, it is recommended that the combined weight of components (A) and (B) be at least 60%, and more preferably at least 70%, of the weight of the overall cover layer.

The thermoplastic polyurethane (A) has a structure which includes soft segments composed of a polymeric polyol (polymeric glycol) that is a long-chain polyol, and hard segments composed of a chain extender and a polyisocyanate compound. Here, the long-chain polyol serving as a starting material may be any that has hitherto been used in the art relating to thermoplastic polyurethanes, and is not particularly limited. Illustrative examples include polyester polyols, polyether polyols, polycarbonate polyols, polyester polycarbonate polyols, polyolefin polyols, conjugated diene polymer-based polyols, castor oil-based polyols, silicone-based polyols and vinyl polymer-based polyols. These long-chain polyols may be used singly, or two or more may be used in combination. Of these, in terms of being able to synthesize a thermoplastic polyurethane having a high rebound resilience and excellent low-temperature properties, a polyether polyol is preferred.

Any chain extender that has hitherto been employed in the art relating to thermoplastic polyurethanes may be advantageously used as the chain extender. For example, low-molecular-weight compounds with a molecular weight of 400 or less which have on the molecule two or more active hydrogen atoms capable of reacting with isocyanate groups are preferred. Illustrative, non-limiting, examples of the chain extender include 1,4-butylene glycol, 1,2-ethylene glycol, 1,3-butanediol, 1,6-hexanediol and 2,2-dimethyl-1,3-propanediol. Of these, an aliphatic diol having 2 to 12 carbons is preferred, and 1,4-butylene glycol is more preferred, as the chain extender.

Any polyisocyanate compound hitherto employed in the art relating to thermoplastic polyurethanes may be advantageously used without particular limitation as the polyisocyanate compound. For example, use may be made of one, two or more selected from the group consisting of 4,4'-diphenylmethane diisocyanate, 2,4-toluene diisocyanate, 2,6-toluene diisocyanate, p-phenylene diisocyanate, xylylene diisocyanate, 1,5-naphthylene diisocyanate, tetramethylxylene diisocyanate, hydrogenated xylylene diisocyanate, dicyclohexylmethane diisocyanate, tetramethylene diisocyanate, hexamethylene diisocyanate, isophorone diisocyanate, norbornene diisocyanate, trimethylhexamethylene diisocyanate and dimer acid diisocyanate. However, depending on the type of isocyanate, the crosslinking reaction during injection molding may be difficult to control. To provide a balance between stability at the time of production and the properties that are manifested, it is most preferable to use the following aromatic diisocyanate: 4,4'-diphenylmethane diisocyanate.

Commercially available products may be used as the thermoplastic polyurethane serving as component (A). Illustrative examples include Pandex T-8295, T-8290, T-8283 and T-8260 (all from DIC Bayer Polymer, Ltd.).

Although not an essential ingredient, a thermoplastic elastomer (C) other than the above thermoplastic polyurethane may be included as an additional component together with above components (A) and (B). By including this component (C) in the above resin blend, a further improvement in the flowability of the resin blend can be achieved and the properties required of a golf ball cover material, such as resilience and scuff resistance, can be enhanced.

The relative proportions of above components (A), (B) and (C) are not particularly limited. However, to fully elicit desirable effects with regard to resilience and the like, the weight ratio (A):(B):(C) is preferably from 100:2:50 to 100:50:0, and more preferably from 100:2:50 to 100:30:8.

In addition, various additives may be optionally included in the above resin blend. For example, pigments, dispersants, antioxidants, light stabilizers, ultraviolet absorbers and internal mold lubricants may be suitably included.

The manufacture of multi-piece solid golf balls in which the above-described two-layer core, intermediate layer and cover (outermost layer) are formed as successive layers may be carried out by a customary method such as a known injection-molding process. For example, a multi-piece golf ball may be obtained by placing a two-layer core in a given injection mold, injecting an intermediate layer material over the core to give an intermediate sphere, and subsequently placing the resulting sphere in another injection mold and injection-molding a cover (outermost layer) material over the sphere. Alternatively, a cover (outermost layer) may be formed over the intermediate sphere by a method that involves encasing the intermediate sphere with a cover, this being carried out by, for example, enclosing the intermediate sphere within two half-cups that have been pre-molded into hemispherical shapes, and then molding under applied heat and pressure.

It is preferable for the golf ball of the invention to satisfy the condition:

$$PS_7/S/H\times100\geq5.90\ (mm^{-1}),$$

where $PS_7$ is the pressed area ($mm^2$), defined as the area of the golf ball that comes into contact with a flat surface, when the ball is subjected to a load of 6,864 N (700 kgf), S is the hypothetical planar area ($mm^2$), defined as the surface area of a cross-sectional circle along the ball diameter were the surface of the ball to be entirely free of dimples, and H is the deflection (mm) of the ball when compressed under a final load of 1,275 N (130 kgf) from an initial load of 98 N (10 kgf).

By having the pressed area of the golf ball under loading on a driver shot by an ordinary golfer satisfy the above condition, the surface area of contact between the ball and golf club increases and frictional forces with the club rise, as a result of which the amount of back spin on driver shots decreases, enabling the distance to be improved.

It is preferable also for the golf ball of the invention to satisfy the condition:

$$PS_2/S/H\times100\geq1.70\ (mm^{-1}),$$

where $PS_7$ is the pressed area ($mm^2$), defined as the area of the golf ball that comes into contact with a flat surface, when the ball is subjected to a load of 1,961 N (200 kgf), S is the hypothetical planar area ($mm^2$), defined as the surface area of a cross-sectional circle along the ball diameter were the surface of the ball to be entirely free of dimples, and H is the deflection (mm) of the ball when compressed under a final load of 1,275 N (130 kgf) from an initial load of 98 N (10 kgf).

By having the pressed area of the golf ball under loading on an approach shot by an ordinary golfer satisfy the above condition, the surface area of contact between the ball and golf club increases and frictional forces with the club rise, as a result of which the amount of back spin on approach shots increases, enabling movement of the ball to be stopped in a straighter line near the landing point of the ball.

The hypothetical planar surface area S of the golf ball is determined by the ball diameter. The diameter may be set in conformity with the Rules of Golf for play, this being of a size such that the ball does not pass through a ring having an inner diameter of 42.672 mm and is not more than 42.80 mm.

Figure 3A:
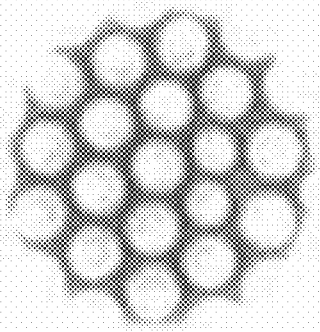
FIGS. 3A and 3B show explanatory diagrams for a method of determining the pressed area of a golf ball.
Figure 3B:
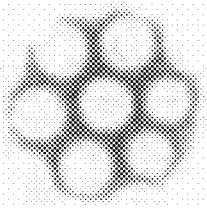

The pressed areas $PS_7$ and $PS_2$ of the golf ball under predetermined loads represent the areas of contact by the golf ball with the golf club at the time of a given shot. These areas of contact have been made larger than in the prior art by means of the dimple structure. However, the pressed area PS is dependent on the size of the golf ball, becoming larger when the golf ball dimensions are larger and becoming smaller when the golf ball dimensions are smaller. Hence, by dividing the pressed area by the hypothetical planar surface area S and expressing the result as a percentage, it is possible to evaluate the increase in the area of contact due to the dimple construction without being affected by the size of the golf ball. The pressed area PS is also dependent on the deflection H of the golf ball, becoming larger when the deflection H is larger, and becoming smaller when the deflection H is smaller. Therefore, by dividing the pressed area by the deflection H, it is possible to evaluate the increase in the area of contact due to the dimple construction without being affected by the amount of deflection by the golf ball. Measurement of the pressed area may be carried out by, for example, placing pressure-sensitive paper on a flat surface, setting the golf ball to be tested on the paper, applying a load of 6,864 N (700 kgf) or 1,961 (200 kgf) to the golf ball, and measuring the total area of the portion of the pressure-sensitive paper that has become colored as a result of contact with the golf ball. FIG. 3A shows an example of pressure-sensitive paper that was actually colored when a load of 6,864 N (700 kgf) was applied to a golf ball, and FIG. 3B shows an example of pressure-sensitive paper that was actually colored when a load of 1,861 N (200 kgf) was applied to the same golf ball. In these diagrams, the round areas are dimples, and the solid (blackened) places indicate the colored portions. The area of the colored portions can be easily determined by using a commercial pressure image analysis system.

Numerous dimples may be formed on the cover (outermost layer). The number of dimples arranged on the cover surface, although not particularly limited, may be set to preferably at least 250, and more preferably at least 300, with the upper limit being preferably not more than 500, and more preferably not more than 450.

The dimple surface coverage SR (i.e., the ratio of the sum of the individual dimple areas with respect to the total surface area of the hypothetical sphere were the ball assumed to have no dimples thereon) is set to preferably at least 70%, more preferably at least 75%, and even more preferably at least 80%. The maximum dimple surface coverage ratio SR, although not particularly limited, is preferably not more than 99%. It is especially desirable for the ball to be provided with at least three types of dimples of differing size, and for the dimples to be thereby uniformly arranged on the spherical surface of the ball without leaving gaps.

The dimple volume occupancy VR (i.e., the sum of the volumes of the individual dimples, each formed below the flat plane circumscribed by the edge of a dimple, expressed as a ratio with respect to the volume of the hypothetical sphere were the ball assumed to have no dimples thereon) is set to preferably at least 0.75%, more preferably at least 0.80%, and even more preferably at least 1.1%. The upper limit in the dimple volume occupancy VR is preferably not more than 1.5%, and more preferably not more than 1.4%.

EXAMPLES

The following Examples and Comparative Examples are provided to illustrate the invention, and are not intended to limit the scope thereof.

Examples 1 to 3, Comparative Examples 1 to 3

Formation of Core

Inner core layers having the rubber compositions shown in Table 1 were formed under the vulcanization temperatures and times shown in the same table. Next, outer layer cores having the rubber compositions shown in Table 2 were formed over the inner core layers under the vulcanization temperatures and times shown in Table 2, thereby producing solid cores of rubber having the inner and outer core layers in the respective Working Examples of the invention and the Comparative Examples.

TABLE 1

| | | Example | | | Comparative Example | | |
|---|---|---|---|---|---|---|---|
| | | 1 | 2 | 3 | 1 | 2 | 3 |
| Inner core layer formulation (pbw) | Polybutadiene A | 80 | 80 | 80 | | 80 | 80 |
| | Polybutadiene B | 20 | 20 | 20 | 100 | 20 | 20 |
| | Zinc acrylate | 30 | 30 | 30 | 22 | 30 | 30 |
| | Organic peroxide (1) | 1 | 1 | 1 | | 1 | 1 |
| | Organic peroxide (2) | | | | 1.2 | | |
| | Water | 0.8 | 0.8 | 0.8 | | 0.8 | 0.8 |
| | Antioxidant | 0.1 | 0.1 | 0.1 | 0.1 | 0.1 | 0.1 |
| | Barium sulfate | 17.7 | 17.7 | 17.7 | | 17.7 | 17.7 |
| | Zinc oxide | 4 | 4 | 4 | 24.3 | 4 | 4 |
| | Zinc stearate | | | | 5 | | |
| | Zinc salt of pentachlorothiophenol | 0.2 | 0.2 | 0.2 | 2 | 0.2 | 0.2 |
| Vulcanization conditions | Temperature (° C.) | 155 | 155 | 155 | 155 | 155 | 155 |
| | Time (min.) | 15 | 15 | 15 | 15 | 15 | 15 |

TABLE 2

| | | Example | | | Comparative Example | | |
|---|---|---|---|---|---|---|---|
| | | 1 | 2 | 3 | 1 | 2 | 3 |
| Outer core layer formulation | Polybutadiene A | 100 | 100 | 100 | 100 | 100 | 100 |
| | Zinc acrylate | 32 | 29 | 29 | 33 | 21.5 | 32 |
| | Organic peroxide (1) | 0.6 | 0.6 | 0.6 | | 0.6 | 0.6 |

TABLE 2-continued

| | | Example | | | Comparative Example | | |
|---|---|---|---|---|---|---|---|
| | | 1 | 2 | 3 | 1 | 2 | 3 |
| (pbw) | Organic peroxide (2) | 0.6 | 0.6 | 0.6 | 1.2 | 0.6 | 0.6 |
| | Antioxidant | | | | 0.1 | | |
| | Barium sulfate | 16.6 | 16.4 | 16.4 | | 20.4 | 16.6 |
| | Zinc oxide | 5 | 5 | 5 | 24.9 | 5 | 5 |
| | Zinc stearate | 5 | 5 | 5 | 5 | 5 | 5 |
| | Zinc salt of pentachlorothiophenol | 1 | 1 | 1 | 1 | 1 | 1 |
| Vulcanization conditions | Temperature (° C.) | 155 | 155 | 155 | 155 | 155 | 155 |
| | Time (min.) | 10 | 10 | 10 | 10 | 10 | 10 |

Details on the ingredients shown in Tables 1 and 2 are given below.

Polybutadiene A: Available under the trade name "BR 01" from JSR Corporation

Polybutadiene B: Available under the trade name "BR 51" from JSR Corporation

Zinc acrylate: Available from Nippon Shokubai Co., Ltd.

Organic peroxide (1): Dicumyl peroxide, available under the trade name "Percumyl D" from NOF Corporation Organic peroxide (2): A mixture of 1,1-di(t-butylperoxy)-cyclohexane and silica, available under the trade name "Perhexa C-40" from NOF Corporation Water: Distilled water, from Wako Pure Chemical Industries, Ltd.

Antioxidant: 2,2'-Methylenebis(4-methyl-6-butylphenol), available under the trade name "Nocrac NS-6" from Ouchi Shinko Chemical Industry Co., Ltd.

Barium sulfate: Available under the trade name "Barico #300" from Hakusui Tech

Zinc oxide: Available under the trade name "Zinc Oxide Grade 3" from Sakai Chemical Co., Ltd.

Zinc stearate: Available under the trade name "Zinc Stearate G" from NOF Corporation Zinc salt of pentachlorothiophenol: Available from ZHEJIANG CHO & FU CHEMICAL.

Formation of Intermediate Layer and Cover

An intermediate layer material formulated as shown in Table 3 was injected-molded over the two-layer core obtained above, thereby giving an intermediate layer-encased sphere. Next, using the cover material formulated as shown in Table 3, a cover (outermost layer) was injection-molded over the intermediate layer-encased sphere, thereby producing a golf ball having an intermediate layer and a cover (outermost layer) over the core.

TABLE 3

| Resin materials (pbw) | I | II | III | IV |
|---|---|---|---|---|
| T-8295 | | | 75 | 100 |
| T-8290 | | | 25 | |
| Himilan ® 1706 | 35 | | | |
| Himilan ® 1557 | 15 | | | |
| Himilan ® 1605 | 50 | | | |
| AN4319 | | 20 | | |
| AN4221C | | 80 | | |
| Hytrel ® 4001 | | | 11 | 11 |
| Titanium oxide | | | 3.9 | 3.9 |
| Polyethylene wax | | | 1.2 | 1.2 |
| Isocyanate compound | | | 7.5 | 7.5 |
| Trimethylolpropane | 1.1 | | | |
| Magnesium stearate | | 60 | | |
| Calcium hydroxide | | 1.5 | | |

TABLE 3-continued

| Resin materials (pbw) | I | II | III | IV |
|---|---|---|---|---|
| Magnesium oxide | | 1 | | |
| Polytail H | | 8 | | |

Details on the materials shown in Table 3 are as follows.

T-8295, T-8290: MDI-PTMG type thermoplastic polyurethanes available from DIC Bayer Polymer under the trademark Pandex.

Himilan® 1706, Himilan® 1557, Himilan® 1605: Ionomers available from DuPont-Mitsui Polychemicals Co., Ltd.

AN4319: An unneutralized ethylene-methacrylic acid-ester component terpolymer (from DuPont-Mitsui Polychemicals Co., Ltd.)

AN4221C: An unneutralized ethylene-acrylic acid copolymer (from DuPont-Mitsui Polychemicals Co., Ltd.)

Hytrel 4001: A polyester elastomer available from DuPont-Toray Co., Ltd.

Polyethylene wax: "Sanwax 161P" from Sanyo Chemical Industries, Ltd.

Isocyanate compound: 4,4'-Diphenylmethane diisocyanate

Magnesium stearate: "Magnesium Stearate G" from NOF Corporation

Calcium hydroxide: "Calcium Hydroxide CLS-B" from Shiraishi Calcium Kaisha, Ltd.

Magnesium oxide: "Kyowamag MF 150" from Kyowa Chemical Industry Co., Ltd.

Polytail H: Available from Mitsubishi Chemical Corporation

At this time, dimples having the parameters shown in Table 4 below were formed on the cover surface in the respective Working Examples and Comparative Examples. Six types of dimples of differing diameters as shown in Table 4 were arranged on the golf balls in each of the Working Examples and Comparative Examples, and set to the same surface coverage ratio SR.

TABLE 4

| No. | Number of dimples | Diameter (mm) | SR (%) |
|---|---|---|---|
| 1 | 12 | 4.6 | 81 |
| 2 | 234 | 4.4 | |
| 3 | 60 | 3.8 | |
| 4 | 6 | 3.5 | |
| 5 | 6 | 3.4 | |
| 6 | 12 | 2.6 | |
| Total | 330 | | |

Dimple Definitions

Diameter: Diameter of flat plane circumscribed by edge of dimple (mm).

SR: Sum of individual dimple areas as a percentage of the total surface area of a hypothetical sphere were the golf ball to have no dimples thereon (unit: %)

Two dimple shapes were used. Dimple A (FIG. 1) was used in Working Examples 1 and 2 and Comparative Examples 1 to 3, and Dimple B (FIG. 2) was used only in Working Example 3. Of the six types of dimples of differing diameter in Table 4, the structures of the typical dimples having a diameter of 4.4 mm were as follows.

Dimple A

Figure 1B:
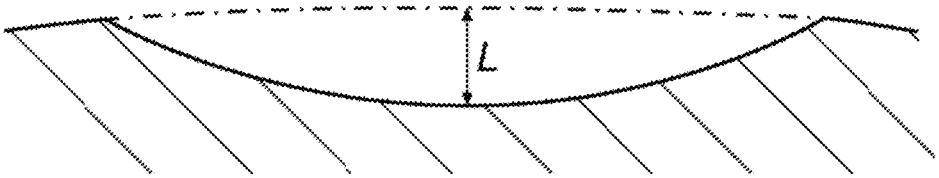

In the cross-sectional shape in FIG. 1, the depth L at the deepest point is 0.150 mm.

Dimple B

Figure 2A:
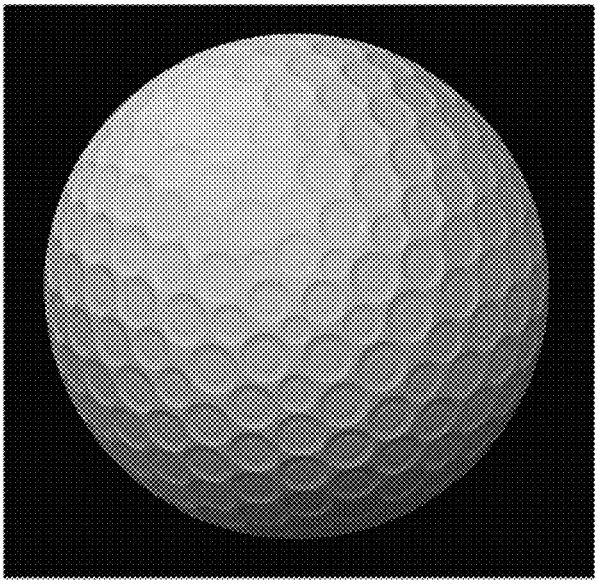
FIGS. 2A and 2B are enlarged cross-sectional diagrams of dimples on the golf ball used in Working Example 3.
Figure 2B:
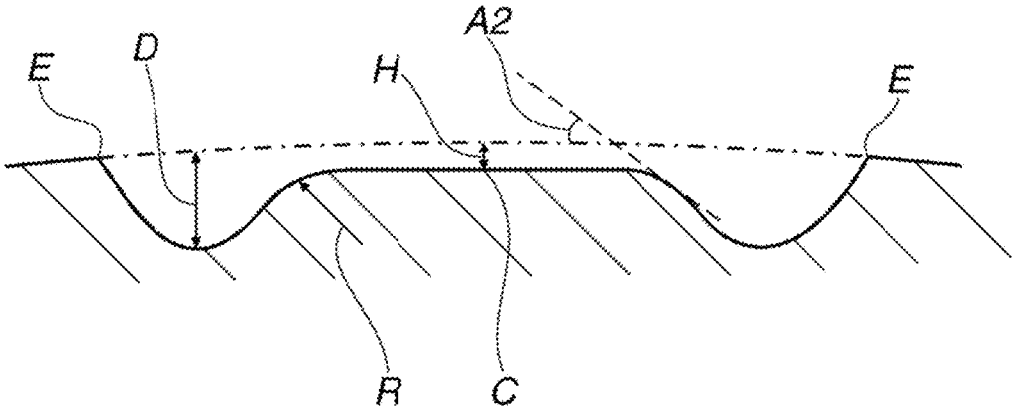

In the cross-sectional shape in FIG. 2, the depth H at the center point C is 0.097 mm, the depth D at the deepest point is 0.131 mm, the distance from the outer peripheral edge E to the position of the deepest point, relative to an arbitrary distance of 100 from the outer peripheral edge E to the center point C, is 39, the radius of curvature R is 0.5 mm, and the edge angle A2 is 10.5°.

For each of the resulting golf balls, properties such as the core hardness profile, thicknesses and material hardnesses of the respective layers, and the surface hardnesses of various layer-encased spheres were evaluated by the methods described below. The results are shown in Table 5.

Core Hardness Profile

The indenter of a durometer was set so as to be substantially perpendicular to the spherical surface of the core, and the core surface hardness in terms of JIS-C hardness was measured as specified in JIS K6301-1975.

To obtain the cross-sectional hardnesses at the center and other specific positions of the core, the core was hemispherically cut so as form a planar cross-section, and measurements were carried out by pressing the indenter of a durometer perpendicularly against the cross-section at the measurement positions. These hardnesses are indicated as JIS-C hardness values.

The Shore D hardnesses at the center of the inner core layer and the surface of the outer core layer were measured with a type D durometer in accordance with ASTM D2240-95.

Diameters of Inner Core Layer, Outer Core Layer-Encased Sphere and Intermediate Layer-Encased Sphere The diameters at five random places on the surface were measured at a temperature of 23.9±1° C. and, using the average of these measurements as the measured value for a single inner core layer, outer core layer-encased sphere (entire core) or intermediate layer-encased sphere, the average diameter for five measurement specimens was determined.

Ball Diameter

The diameters at five random dimple-free areas on the surface of a ball were measured at a temperature of 23.9±1° C. and, using the average of these measurements as the measured value for a single ball, the average diameter for five measured balls was determined.

Deflections of Inner Core Layer, Outer Core Layer-Encased Sphere, Intermediate Layer-Encased Sphere and Ball An inner core layer, outer core layer-encased sphere (overall core), intermediate layer-encased sphere or ball was placed on a hard plate and the amount of deflection when compressed under a final load of 1,275 N (130 kgf) from an initial load of 98 N (10 kgf) was measured. The amount of deflection here refers in each case to the measured value obtained after holding the test specimen isothermally at 23.9° C.

Material Hardnesses of Intermediate Layer and Cover (Shore D Hardnesses)

The intermediate layer and cover-forming resin materials were molded into sheets having a thickness of 2 mm and left to stand for at least two weeks, following which the Shore D hardnesses were measured in accordance with ASTM D2240-95.

Surface Hardnesses of Intermediate Layer-Encased Sphere and Ball (Shore D Hardnesses)

Measurements were taken by pressing the durometer indenter perpendicularly against the surface of the intermediate layer-encased sphere or ball (i.e., the surface of the cover). The surface hardness of the ball (cover) is the measured value obtained at dimple-free places (lands) on the ball surface. The Shore D hardnesses were measured with a type D durometer in accordance with ASTM D2240-95.

Pressed Area

Measurement of the pressed area PS of a golf ball was carried out by placing pressure-sensitive paper (Prescale pressure measurement film for medium pressure, available from Fujifilm Corporation) on a flat surface, and setting a golf ball from the respective Working Examples and Comparative Examples thereon. Next, using a model 4202 tester from Instron Corporation, loads of 6,864 N (700 kgf) and 1,961 N (200 kgf) were applied to these golf balls, and the total area of the portion of the pressure-sensitive paper that became colored due to contact with the golf ball was measured. The area of the colored portion was determined using the FPD-9270 Prescale Pressure Image Analysis System (Fujifilm Corporation). In each case, the pressed area is the result of measurement at a single arbitrary position on the golf ball.

TABLE 5

| | | | Example | | | Comparative Example | | |
|---|---|---|---|---|---|---|---|---|
| | | | 1 | 2 | 3 | 1 | 2 | 3 |
| Inner core layer | | Material | rubber | rubber | rubber | rubber | rubber | rubber |
| | | Diameter (mm) | 35.20 | 35.20 | 35.20 | 21.50 | 35.20 | 35.20 |
| | | Weight (g) | 26.5 | 26.5 | 26.5 | 6.0 | 26.5 | 26.5 |
| | | Specific gravity | 1.159 | 1.159 | 1.159 | 1.159 | 1.159 | 1.159 |
| | | Deflection (mm) | 4.3 | 4.3 | 4.3 | 6.0 | 4.3 | 4.3 |
| | Hardness profile | Center hardness: Cc (JIS-C) | 53 | 53 | 53 | 55 | 53 | 53 |
| | | (Shore D) | 32 | 32 | 32 | 34 | 32 | 32 |
| | | Hardness at position 5 mm from center: C5 (JIS-C) | 61 | 61 | 61 | 60 | 61 | 61 |
| | | Hardness at position 10 mm from center: C10 (JIS-C) | 64 | 64 | 64 | 60 | 64 | 64 |

TABLE 5-continued

| | | | Example | | | Comparative Example | | |
|---|---|---|---|---|---|---|---|---|
| | | | 1 | 2 | 3 | 1 | 2 | 3 |
| | | Hardness at position 15 mm from center: C15 (JIS-C) | 78 | 78 | 78 | — | 78 | 78 |
| | | C10 − Cc (JIS-C) | 11 | 11 | 11 | 5 | 11 | 11 |
| | | C5 − Cc (JIS-C) | 8 | 8 | 8 | 5 | 8 | 8 |
| | | C10 − C5 (JIS-C) | 3 | 3 | 3 | 0 | 3 | 3 |
| | | C15 − C10 (JIS-C) | 14 | 14 | 14 | — | 14 | 14 |
| | | Cs − C15 (JIS-C) | 13 | 8 | 8 | — | −3 | 13 |
| Outer core layer | | Material | rubber | rubber | rubber | rubber | rubber | rubber |
| | | Thickness (mm) | 1.67 | 1.67 | 1.67 | 8.50 | 1.67 | 1.67 |
| Outer core layer-encased sphere | | Diameter (mm) | 38.54 | 38.54 | 38.54 | 38.50 | 38.54 | 38.54 |
| | | Weight (g) | 34.8 | 34.8 | 34.8 | 34.8 | 34.8 | 34.8 |
| | | Specific gravity | 1.159 | 1.159 | 1.159 | 1.159 | 1.159 | 1.159 |
| | | Deflection (mm) | 3.6 | 3.7 | 3.7 | 3.7 | 3.9 | 3.6 |
| | Hardness profile | Surface hardness: Cs (JIS-C) | 91 | 86 | 86 | 84 | 75 | 91 |
| | | (Shore D) | 61 | 57 | 57 | 56 | 49 | 61 |
| | | Outer core layer surface − inner core layer center: Cs − Cc (JIS-C) | 38 | 33 | 33 | 29 | 22 | 38 |
| | | (Shore D) | 29 | 25 | 25 | 22 | 17 | 29 |
| | | Cs − C10 (JIS-C) | 27 | 22 | 22 | 24 | 11 | 27 |
| | | (Cs − C10)/(C10 − Cc) | 2.5 | 2.0 | 2.0 | 4.8 | 1.0 | 2.5 |
| | | (Deflection of inner core layer)/(Deflection of outer core layer-encased sphere) | 1.2 | 1.2 | 1.2 | 1.6 | 1.1 | 1.2 |
| Intermediate layer | | Material | I | I | I | I | I | II |
| | | Thickness (mm) | 1.26 | 1.26 | 1.26 | 1.28 | 1.26 | 1.26 |
| | | Specific gravity | 0.95 | 0.95 | 0.95 | 0.95 | 0.95 | 0.95 |
| | | Material hardness (Shore D) | 62 | 62 | 62 | 62 | 62 | 55 |
| Intermediate layer-encased sphere | | Diameter (mm) | 41.06 | 41.06 | 41.06 | 41.06 | 41.06 | 41.06 |
| | | Weight (g) | 40.7 | 40.7 | 40.7 | 40.8 | 40.7 | 40.7 |
| | | Deflection (mm) | 2.9 | 3.0 | 3.0 | 3.0 | 3.2 | 3.1 |
| | | Surface hardness (Shore D) | 68 | 68 | 68 | 68 | 68 | 61 |
| | | Intermediate layer surface hardness − Outer core layer surface hardness (Shore D) | 7 | 11 | 11 | 12 | 19 | 0 |
| | | (Deflection of inner core layer)/(Deflection of intermediate layer-encased sphere) | 1.5 | 1.4 | 1.4 | 2.0 | 1.3 | 1.4 |
| Cover | | Material | III | III | III | III | III | IV |
| | | Thickness (mm) | 0.82 | 0.82 | 0.82 | 0.82 | 0.82 | 0.82 |
| | | Specific gravity | 1.15 | 1.15 | 1.15 | 1.15 | 1.15 | 1.15 |
| | | Material hardness (Shore D) | 53 | 53 | 53 | 53 | 53 | 56 |
| | | Dimples | A | A | B | A | A | A |
| Ball | | Diameter (mm) | 42.70 | 42.70 | 42.70 | 42.70 | 42.70 | 42.70 |
| | | Weight (g) | 45.7 | 45.7 | 45.7 | 45.7 | 45.7 | 45.7 |
| | | H: deflection (mm) | 2.7 | 2.8 | 2.8 | 2.8 | 3.0 | 2.9 |
| | | Surface hardness (Shore D) | 65 | 65 | 65 | 65 | 65 | 67 |
| | | (Deflection of inner core layer)/(Deflection of ball) | 1.6 | 1.5 | 1.5 | 2.1 | 1.4 | 1.5 |
| | | Ball surface hardness − Intermediate layer surface hardness (Shore D) | −3 | −3 | −3 | −3 | −3 | 6 |
| | | Intermediate layer thickness − Cover thickness (mm) | 0.44 | 0.44 | 0.44 | 0.46 | 0.44 | 0.44 |
| | | Deflection of Inner core layer − Deflection of ball (mm) | 1.6 | 1.5 | 1.5 | 3.2 | 1.3 | 1.4 |
| | | S: Hypothetical planar area ($mm^2$) | 1,432 | 1,432 | 1,432 | 1,432 | 1,432 | 1,432 |
| | | PS7: Pressed area when loaded at 6,864 N ($mm^2$) | 236 | 243 | 276 | 243 | 257 | 250 |
| | | PS2: Pressed area when loaded at 1,961 N ($mm^2$) | 70 | 73 | 81 | 73 | 77 | 75 |
| | | Formula 1: PS7/S/H × 100 ($mm^{-1}$) | 6.09 | 6.05 | 6.88 | 6.05 | 5.99 | 6.02 |
| | | Formula 2: PS2/S/H × 100 ($mm^{-1}$) | 1.82 | 1.81 | 2.02 | 1.81 | 1.80 | 1.80 |

In addition, the flight performance (W#1) and spin performance on approach shots of the golf balls obtained in the respective Examples of the invention and the Comparative Examples were evaluated according to the criteria indicated below. The results are shown in Table 6.

Flight Performance (W#1 Shots)

A driver (W#1) was mounted on a golf swing robot, and the distance traveled by the ball when struck at a head speed (HS) of 45 m/s was measured and rated according to the criteria shown below. The club was a TourStage X-Drive709 D430 driver (2013 model, loft angle, 9.5°). This head speed corresponds to the average head speed of mid- to high-level amateur golfers.

Rating Criteria:

Good: Total distance was 225.0 m or more

NG: Total distance was less than 225.0 m

Spin Performance on Approach Shots

A sand wedge was mounted on a golf swing robot, and the spin rate of the ball when hit at a head speed (HS) of 35 m/s was rated according to the following criteria.

Rating Criteria:

Good: Spin rate was 5,900 rpm or more

NG: Spin rate was less than 5,900 rpm

TABLE 6

| | | Example | | | Comparative Example | | |
|---|---|---|---|---|---|---|---|
| | | 1 | 2 | 3 | 1 | 2 | 3 |
| Flight performance W#1 HS, 45 m/s | Spin rate (rpm) | 3,083 | 3,113 | 3,023 | 3,105 | 3,185 | 3,065 |
| | Total distance (m) | 226.4 | 225.9 | 226.3 | 224.7 | 224.0 | 226.6 |
| | Rating | good | good | good | NG | NG | good |
| Performance on approach shots | Spin rate (rpm) | 5,963 | 5,955 | 6,045 | 5,945 | 5,911 | 5,734 |
| | Rating | good | good | good | good | good | NG |

The following observations are based on the test results in Table 6.

In Comparative Example 1, the inner core layer has a small diameter. As a result, the initial velocity when struck with a driver (W#1) was slow and a good distance was not achieved.

In Comparative Example 2, the surface hardness of the outer core layer was low. As a result, the spin rate-lowering effect on shots with a W#1 was inadequate and a good distance was not achieved.

In Comparative Example 3, because the cover was harder than the intermediate layer, the ball was not sufficiently receptive to spin on approach shots and so the desired spin effect on approach shots was not obtained.

Japanese Patent Application No. 2015-172780 is incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

The invention claimed is:

1. A multi-piece solid golf ball comprising a rubber two-layer core consisting of an inner layer and an outer layer, a cover, and at least one intermediate layer between the core and the cover, wherein the inner core layer has a diameter of at least 30 mm, the value obtained by subtracting a center hardness of the inner core layer from a surface hardness of the outer core layer, expressed in terms of JIS-C hardness, is at least 25, the ball satisfies the relationship A/B≤1.5, where A is the deflection (mm) of the inner core layer when compressed under a final load of 1,275 N (130 kgf) from an initial load of 98 N (10 kgf) and B is the deflection (mm) of the two-layer core when compressed under a final load of 1,275 N (130 kgf) from an initial load of 98 N (10 kgf), and the intermediate layer has a higher material hardness than the cover, wherein the multi-piece solid golf ball satisfies the condition:

$$C10-C5 \leq C5-Cc \leq Cs-C15 \leq C15-C10, \quad \text{(viii)}$$

where Cc is the JIS-C hardness at a center of the core, C5 is the JIS-C hardness at a position 5 mm from the core center, C10 is the JIS-C hardness at a position 10 mm from the core center, C15 is the JIS-C hardness at a position 15 mm from the core center, and Cs is the JIS-C hardness at a surface of the core.

2. The golf ball of claim 1, wherein the core has a hardness profile which satisfies the conditions:

$$1 \leq C10-Cc \leq 15, \quad \text{(i)}$$

$$C10-Cc < Cs-C10, \quad \text{(ii)}$$

$$18 \leq Cs-C10, \quad \text{(iii)}$$

$$Cs \geq 80, \text{ and} \quad \text{(iv)}$$

$$Cc \geq 50. \quad \text{(v)}$$

3. The golf ball of claim 1 which satisfies the condition:

$$1.5 \leq (Cs-C10)/(C10-Cc) \leq 4. \quad \text{(vi)}$$

4. The golf ball of claim 1 which satisfies the condition:

$$25 \leq Cs-Cc \leq 45. \quad \text{(vii)}$$

5. The golf ball of claim 1 which satisfies the relationship A/C≤1.9, where C is the deflection (mm) of a sphere consisting of the core encased by the intermediate layer when the sphere is compressed under a final load of 1,275 N (130 kgf) from an initial load of 98 N (10 kgf).

6. The golf ball of claim 1 which satisfies the relationships A/H≤2.0 and A−H≤2.5, where H is the deflection (mm) of the ball when compressed under a final load of 1,275 N (130 kgf) from an initial load of 98 N (10 kgf).

7. The golf ball of claim 1 which satisfies the condition:

$$PS_7/S/H \times 100 \geq 5.90 \ (mm^{-1}), \quad \text{(ix)}$$

where $PS_7$ is the pressed area ($mm^2$), defined as the area of the golf ball that comes into contact with a flat surface, when the ball is subjected to a load of 6,864 N (700 kgf), S is the hypothetical planar area ($mm^2$), defined as the surface area of a cross-sectional circle along the ball diameter were the surface of the ball to be entirely free of dimples, and H is the deflection (mm) of the ball when compressed under a final load of 1,275 N (130 kgf) from an initial load of 98 N (10 kgf).

8. The golf ball of claim 1 which satisfies the condition:

$$PS_2/S/H \times 100 \geq 1.70 \ (mm^{-1}), \quad \text{(x)}$$

where $PS_2$ is the pressed area ($mm^2$), defined as the area of the golf ball that comes into contact with a flat surface, when the ball is subjected to a load of 1,961 N (200 kgf), S is the hypothetical planar area ($mm^2$), defined as the surface area of a cross-sectional circle along the ball diameter were the surface of the ball to be entirely free of dimples, and H is the deflection (mm) of the ball when compressed under a final load of 1,275 N (130 kgf) from an initial load of 98 N (10 kgf).

* * * * *